US010258093B2

(12) United States Patent
Smart

(10) Patent No.: US 10,258,093 B2
(45) Date of Patent: Apr. 16, 2019

(54) LOW DRAG GARMENT

(71) Applicant: ENDURA LIMITED, West Lothian (GB)

(72) Inventor: Simon Smart, Brackley (GB)

(73) Assignee: Endura Limited (GB)

( * ) Notice: Subject to any disclaimer, the term of this patent is extended or adjusted under 35 U.S.C. 154(b) by 312 days.

(21) Appl. No.: 15/132,935

(22) Filed: Apr. 19, 2016

(65) Prior Publication Data

US 2016/0302495 A1 Oct. 20, 2016

(30) Foreign Application Priority Data

Apr. 20, 2015 (GB) ..... 1506621

(51) Int. Cl.
*A41D 13/00* (2006.01)
*A41D 31/00* (2006.01)
(Continued)

(52) U.S. Cl.
CPC ..... *A41D 13/0015* (2013.01); *A41B 1/08* (2013.01); *A41D 1/08* (2013.01); *A41D 19/00* (2013.01);
(Continued)

(58) Field of Classification Search
CPC ..... A41D 13/0015; A41D 31/00; A41D 1/08; A41D 2400/24; A41D 2600/10;
(Continued)

(56) References Cited

U.S. PATENT DOCUMENTS 5,033,116 A * 7/1991 Itagaki et al. ..... A41D 7/00 114/67 R
5,052,053 A * 10/1991 Peart ..... A41D 13/012 2/2.16
(Continued)

FOREIGN PATENT DOCUMENTS

EP 3 085 258 A1 10/2016
EP 3 085 259 A1 10/2016
(Continued)

OTHER PUBLICATIONS

English language machine translation of JP 2003105608 (doc published Apr. 2003) from https://worldwide.espacenet.com, 16 pages.*
(Continued)

*Primary Examiner* — Amy Vanatta
(74) *Attorney, Agent, or Firm* — Fay Sharpe LLP

(57) ABSTRACT

A low drag garment has a plurality of zones including a first zone A, a second zone B and a third zone C, which are defined in relation to a forward direction of travel M of a person wearing the garment. The first zone A is located generally in an inner front region of the garment, the second zone B is located in an outer front region of the garment and the third zone C is located in a rear region of the garment. The garment is made from a fabric having a textured outer surface with a texture height H, wherein in first zone A the fabric has a mean texture height $H_A$ in the range 0-200 μm, in the second zone B the fabric has a mean texture height $H_B$ that is greater than $H_A$ and preferably in the range of 100-500 μm, and in the third zone C the fabric has a mean texture height $H_e$ that is greater than $H_B$ and preferably greater than 200 μm.

12 Claims, 5 Drawing Sheets

(51) Int. Cl.

| | |
|---|---|
| ***A41B 1/08*** | (2006.01) |
| ***A41D 1/08*** | (2018.01) |
| ***A41D 19/00*** | (2006.01) |
| ***A43B 5/18*** | (2006.01) |
| ***A63B 71/12*** | (2006.01) |

(52) U.S. Cl.
CPC ..... *A41D 31/00* (2013.01); *A43B 5/18* (2013.01); *A63B 71/1225* (2013.01); *A41D 2400/24* (2013.01); *A41D 2500/10* (2013.01); *A41D 2600/10* (2013.01); *A63B 2071/1266* (2013.01)

(58) Field of Classification Search
CPC ..... A41D 1/00; A41D 1/084; A41D 1/082; A41D 19/00; A41D 19/0055; A41D 19/0082; A43B 5/18; A43B 5/00; A43B 71/1225
See application file for complete search history.

(56) References Cited

U.S. PATENT DOCUMENTS

| | | | | |
|---|---|---|---|---|
| 5,386,955 | A | 2/1995 | Savill | |
| 5,809,567 | A * | 9/1998 | Jacobs | A41D 7/00 2/1 |
| 5,887,280 | A | 3/1999 | Waring | |
| 6,438,755 | B1 * | 8/2002 | MacDonald | A41D 13/0015 2/69 |
| 7,856,668 | B2 * | 12/2010 | Demarest | A41D 7/00 2/69 |
| 7,941,869 | B2 * | 5/2011 | Wright | A41D 13/05 2/239 |
| 9,456,641 | B1 * | 10/2016 | Mignone | A41D 13/0015 |
| 2008/0189824 | A1 * | 8/2008 | Rock | D04B 1/02 2/69 |
| 2012/0131720 | A1 | 5/2012 | Nordstrom et al. | |
| 2013/0281234 | A1 | 10/2013 | Ramirez | |
| 2014/0373251 | A1 | 12/2014 | Ramirez | |
| 2016/0120707 | A1 | 5/2016 | Ramirez | |
| 2016/0167344 | A1 | 6/2016 | Arici et al. | |
| 2016/0302494 | A1 | 10/2016 | Smart | |
| 2016/0302495 | A1 | 10/2016 | Smart | |
| 2017/0027248 | A1 | 2/2017 | McFarlane et al. | |

FOREIGN PATENT DOCUMENTS

| | | | | |
|---|---|---|---|---|
| JP | 03137204 | | 6/1991 | |
| JP | 2003105608 | A * | 4/2003 | A41D 13/0015 |
| JP | 2006037311 | A * | 2/2006 | |
| WO | WO 201 0/1 51 68 | | 12/2010 | |
| WO | WO 2015/151820 | A1 | 10/2015 | |

OTHER PUBLICATIONS

British Search Report dated Sep. 16, 2015 for Application No. GB1506621.0.

* cited by examiner

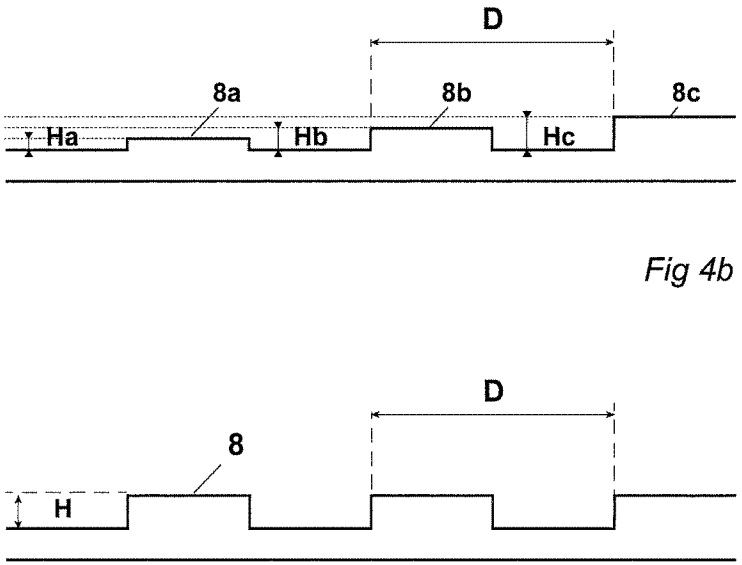
Fig 4b
Fig 4a
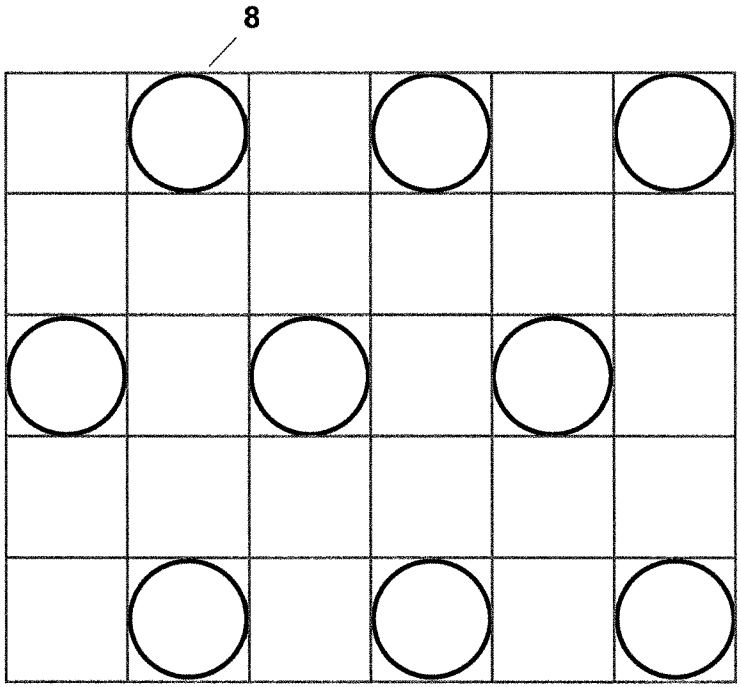
Fig 3

LOW DRAG GARMENT

CROSS-REFERENCE TO RELATED APPLICATION

This application claims foreign priority under 35 U.S.C. 119 to British application no. GB 1506621.0 filed Apr. 20, 2015.

FIELD

The present invention relates to a garment with low aerodynamic drag. In particular, but not exclusively, the invention relates to a garment comprising an article of sports clothing for use in sports such as cycling, running, skiing and speed skating, where aerodynamic drag can have a significant effect on the performance of the athlete.

BACKGROUND

When airflow passes over a body there are two fundamental mechanisms that produce a drag force. These forces come from surface drag, caused by friction as the air passes over the surface, and pressure drag caused primarily by the separation of vortices from the boundary layer. The ratio of surface drag to pressure drag is highly dependent on the shape of the object. Where objects are specifically shaped for optimum aerodynamic efficiency, the aspect ratio (length: width) will generally be at least 3:1. With an increased length to width ratio it is possible to have a wing-like shape with a narrow trailing edge. The advantage of this is that the flow can remain attached to the surface of the object so that the streamlines follow the shape of the profile. Although the surface area of the object and the resulting surface friction are increased, the flow is able to "recover" beyond the widest point of the object, resulting in a small net pressure drag. Generally, the reduction in pressure drag far outweighs the increase in surface drag.

The human body tends to have a much lower aspect ratio, particularly when upright, which may typically be nearer to 1:1 for the arms and legs, and 1:2 for the torso. As a result, the human body approximates to a "bluff body", and pressure drag tends to be by far the larger contributory factor to the overall aerodynamic drag experienced by an athlete.

Where it is not practical to modify the shape of the body and the aspect ratio is lower than about 3:1 in the flow direction, a high level of pressure drag can be caused by flow separation soon after the flow has passed the widest point of the body. In such situations in engineering and nature, it is known to adjust the surface texture of the body to help delay the separation point and thereby reduce the net pressure force that retards motion of the object.

A number of techniques are known to reduce the net drag force on bluff bodies, including the use of trip edges and textured surfaces. Although these techniques may give rise to an increase in surface drag, it is generally possible to find a solution whereby the reduction in pressure drag outweighs the increase in surface drag. This allows the total drag to be reduced in various applications. However, current technologies have the following limitations:

- Trip edges can be very effective in ideal circumstances, but in practice they are extremely sensitive to position. If the trip edges are not placed precisely in the correct locations they can have a detrimental effect, increasing the overall drag. This means that trip edges, or multiple trip edges, are not appropriate for commercial clothing applications, where the exact shape of the body is unknown.
- Environmental conditions can affect the onset of turbulent flow within the system in which the subject is positioned, and are variable and unpredictable. For example, the flow direction experienced by a cyclist can vary by 10° or more from the direction of travel owing to crosswind effects. Experience has shown that it is not possible to have a trip edge that works effectively for all conditions.
- Textured surfaces work to an extent, but the types of textured surfaces available are limited and they are often designed for purposes that are not specific to delaying flow separation.
- Fabrics with different textures are sometimes used in sports clothing and in certain circumstances this can reduce drag. However, changes in fabric texture often require the presence of seams, which can have a detrimental effect on the overall drag. Also, fabrics tend to be provided with uniform repeating texture patterns, which are not optimised to control flow separation.

The ideal surface roughness is heavily dependent on a number of factors, including forward velocity and body shape (curvature and body length), and ideally needs to change constantly along the flow direction to introduce perturbations into the flow that aid flow attachment, whilst not significantly increasing the surface drag. The optimum texture needs to change constantly to provide the correct height and level of disturbance for the air passing over a given point within the boundary layer. Currently, no textile products are available that can offer an optimum level of performance for a given application.

SUMMARY

It is an objective of the present invention to provide a garment with low aerodynamic drag, which mitigates one or more of the problems set out above. Particular preferred objectives of the invention are to reduce the drag of a bluff body, by providing variable surface textures and patterns in three dimensions along the known flow direction. Specifically, a preferred embodiment is designed to work in low speed aerodynamics in the range 6-40 m/sec where laminar flow is still significant, as opposed to higher speed applications such as aerospace and automotive applications where the laminar flow region is negligible and turbulent flow dominates. In particular, it is an objective of the invention to provide low drag garments for use in applications where the input power is limited, for example athletic sports, in which drag reduction can significantly improve performance.

According to one aspect of the present invention there is provided a low drag garment having a plurality of zones including a first zone A, a second zone B and a third zone C, which are defined in relation to a forward direction of travel M of a person wearing the garment, wherein the first zone A is located generally in an inner front region of the garment, the second zone B is located in an outer front region of the garment and the third zone C is located in a rear region of the garment, wherein the garment is made from a fabric having a textured region with a texture height H, wherein in first zone A the textured region has a mean texture height $H_A$ in the range 0-200 μm, in the second zone B the textured region has a mean texture height $H_B$ that is greater than $H_A$ and preferably in the range of 100-500 μm.

The textured surface of the fabric is designed to minimise pressure drag while not significantly increasing surface drag, thereby increasing the athletic performance of the person wearing the garment. In the first zone comprising one or more inner front regions of the garment where the flow is essentially laminar the fabric has a very low texture height in the range 0-200 μm to minimise surface drag. In the second zone comprising one or more outer front regions of the garment where the flow is still essentially laminar and the boundary layer is growing the fabric has an increasing texture height preferably in the range 100-500 μm to turbulate the flow and thereby delay flow separation at the transition point. In the third zone comprising one or more rear regions of the garment where the flow separation has taken place the fabric has the greatest texture height preferably greater than 200 μm to further reduce pressure drag.

In an embodiment, the first zone A comprises at least one region of the garment in which the surface angle θ is less than a maximum value $\theta_A$ in the range 10° to 25°.

The term "surface angle" as used herein is defined as the angle subtended between the direction of forward movement in use, and a line that is perpendicular to the surface of the fabric. In the case of a garment worn by a person, the surface angle is the angle subtended between the direction of forward movement of the person and a line that is perpendicular to the surface of the fabric forming the garment worn by the person.

The second zone B may comprise at least one region of the garment in which the surface angle θ is greater than $\theta_A$ and has a minimum value $\theta_{B1}$ in the range 10° to 25° and a maximum value $\theta_{B2}$ in the range 60°-105°, preferably 60°-95°.

The third zone C may comprise at least one region of the garment in which the surface angle θ is greater than a minimum value $\theta_{C1}$ in the range 60°-105°, preferably 60°-95°.

Optionally, in the third zone C the textured region has a mean texture height $H_C$ that is greater than $H_B$ and preferably greater than 200 μm. Alternatively, in the third zone C the textured region may have a reduced texture height. In some applications the flow of air in the third region may separate from the surface of the fabric and may become erratic: in this case the texture height in the third region may have relatively little impact on the overall aerodynamic performance of the garment.

In an embodiment, the fabric has a texture height H that increases substantially continuously with the surface angle θ in one or more of the first, second and third zones. In an embodiment the texture height H increases substantially continuously with the surface angle θ in all three of the first, second and third zones.

The term "substantially continuously" as used herein in relation to the increasing texture height of the textured outer surface of the fabric is intended to cover both a continuous increase in the texture height and a quasi-continuous increase in texture height consisting of a plurality of incremental or step-wise increases in the texture height, as may be required according to the manufacturing process used. In the latter case the incremental increases in texture height will be very small, for example less than 0.2 mm and preferably no more than 0.1 mm, so that the increase in texture height is effectively continuous.

Optionally, within the textured region the substantially continuous increase in texture height H comprises a plurality of incremental increases in texture height, and wherein each incremental increase in texture height is less than 200 μm, preferably less than 150 μm, more preferably less than 100 μm.

Optionally, the texture height at the start of the second zone is equal to the texture height at the end of the first zone, and the texture height at the start of the third zone is equal to the texture height at the end of the second zone, so that the texture height increases substantially continuously (but not necessarily at the same rate) through all three zones.

Optionally, the textured region comprises a plurality of texture formations having a mean spacing D in the range 1 mm to 40 mm, preferably 2 mm to 20 mm.

Optionally, the fabric has a texture height that varies within a seamless portion of the fabric. It may be preferable to avoid the use of seams since they can disrupt the airflow in unpredictable ways, thereby reducing the aerodynamic efficiency of the garment. For example, the fabric may have a texture that is provided by jacquard knitting of the fabric, or by printing a 3D pattern on the outer surface of the fabric, or by the application of a solid material, for example silicone, to the outer surface of the fabric.

In an embodiment, the garment is an article of sports clothing. The garment may be an article of sports clothing for use in sports where the athlete moves with a speed in the range 6-40 m/s, including for example cycling, running, skiing, horse racing or speed skating.

Optionally, the garment is a shirt, trousers, leggings shorts, bibshorts, shoes, overshoes, arm covers, calf guards, gloves, socks or a bodysuit. Other articles of clothing are of course possible. Preferably the garment is close-fitting to the body so that it follows the contours of the body and does not flap significantly as the air flows over the surface of the garment.

BRIEF DESCRIPTION OF THE DRAWINGS

Embodiments of the present invention will now be described by way of example with reference to the accompanying drawings, wherein:

FIG. 3 is a plan view of a first texture pattern according to an embodiment of the invention;

FIG. 4*a* is a sectional view of the first texture pattern, and FIG. 4*b* is a modified version of the first texture pattern;

DETAILED DESCRIPTION

For the majority of the applications in which use of the invention is envisaged, the Reynolds number will have a value of up to $10^6$, such that the flow of air will be in the laminar/turbulent transition zone. We have therefore used wind tunnel testing to understand and derive optimum textures for use in the invention, and in particular on garments that are worn in applications where they are exposed to an airflow with a speed in the range 6-40 m/sec.

In order to simplify experimentation, much of our research is based on optimising the drag around cylindrical objects with radii of 80 mm, 130 mm and 200 mm. This has enabled us to identify the surface requirements for a wide range of applications. Testing is conducted at a range of speeds and consideration is also given to wind direction. Within the sizes of cylinder used it is possible to approximate a range of curvatures that the airflow will encounter on a human body in a range of applications. For example, for an adult, the upper arm typically has an average radius (based on circumference) of about 50 mm, the thigh typically has an average radius of about 80 mm, and the chest typically has an average radius of about 160 mm. It is of course recognised that the human body is not a perfect cylinder and in regions such as the chest it is closer to an elliptical shape. However, a cylinder provides a good first approximation to an irregular curved body in which the radius of curvature is similar to that of the cylinder.

Our research has identified the optimum height and spacing of the surface texture formations for a range of curvatures, speeds, and onset flow angles. This has allowed us to derive a variable texture that can be utilised to give the best level of airflow perturbation without being sensitive to flow direction changes, whilst minimising the surface friction drag through effective spacing of the textured three-dimensional pattern.

Much research has been done into the change in the drag on a cylindrical body through a range of speeds. It is well known that the drag coefficient falls and then increases again as the speed of the airflow increases for a given cylinder size. This is due to vortex formation and periodic shedding, which affects the laminar transition points behind the cylindrical body.

Figure 2:
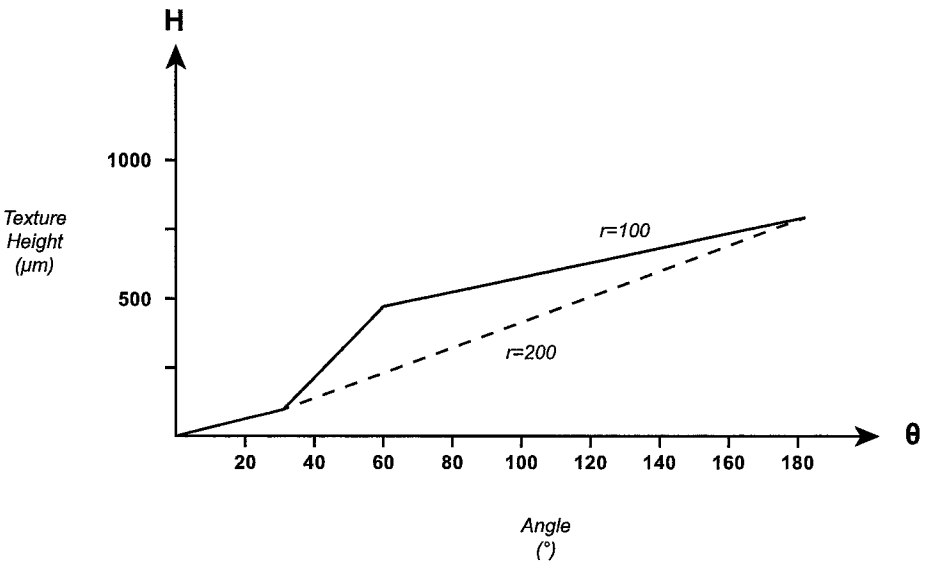
FIG. 2 illustrates graphically a preferred variation in texture height with surface angle for an ideal cylindrical body.

Our research has enabled us to modify this flow behaviour through the use of variable surface roughness and thus minimise the pressure drag for the speed range in question (6-40 m/sec). We have identified a set of characteristic curves for texture height H versus surface angle θ, as shown in FIG. 2, for different curvatures and different air speeds. These characteristic curves may be utilised when designing and manufacturing garments, taking account of the radius of curvature and the surface angle when the garment is worn by an athlete taking part in a particular sport. The surface texture can be modified depending on the air speed that is most likely for a particular application and the position of the fabric on the human body. In practical terms this could mean using a variable texture in a jacquard fabric, a 3D (i.e. raised) printed pattern with variable height, or a pattern produced by the application of a material, e.g. silicone, to the surface of the garment.

Figure 1:
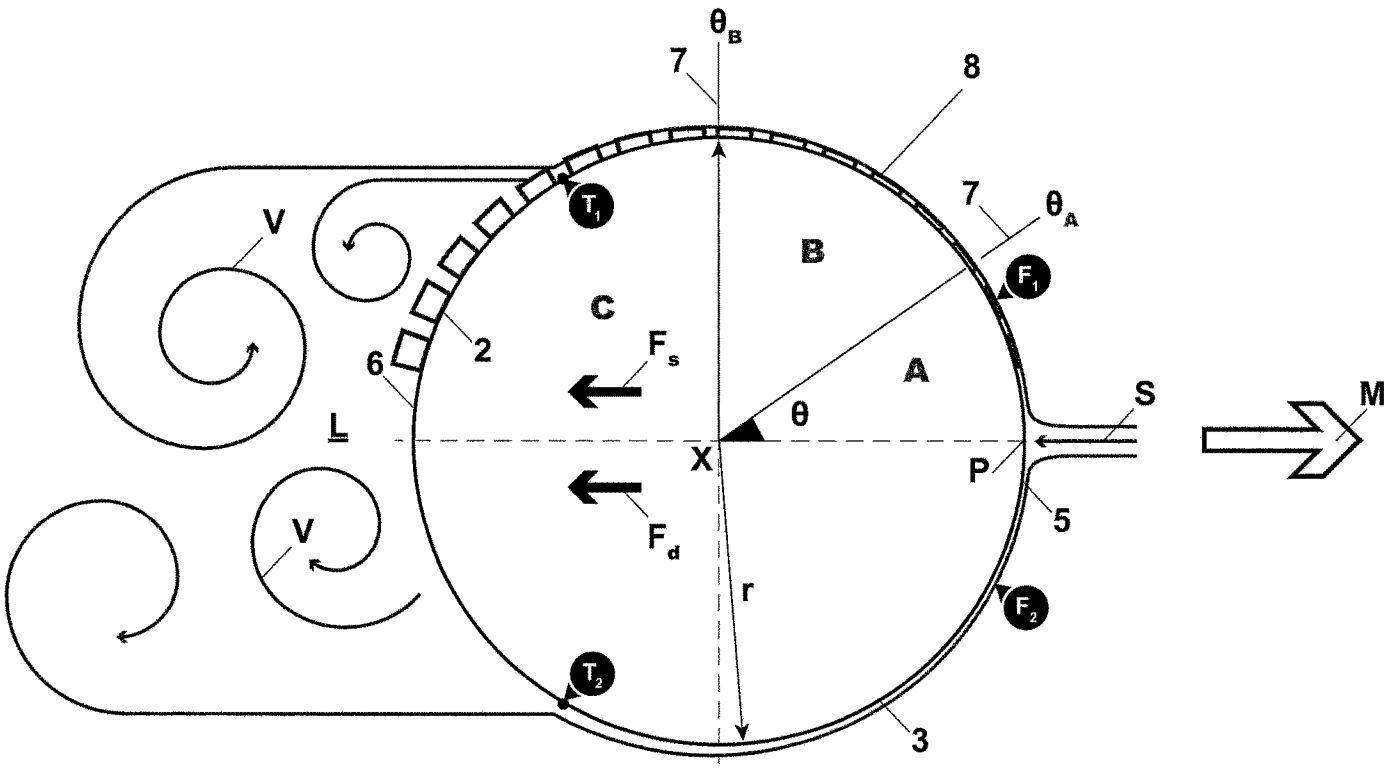
FIG. 1 illustrates schematically the flow of air around a cylindrical object.

FIG. 1 illustrates a typical airflow around a cylindrical body 2, wherein the longitudinal axis X of the cylindrical body is perpendicular to the direction of airflow relative to the cylindrical body. It will be understood that the movement of a body through stationary air may be modelled in a wind tunnel by creating a moving airstream that flows over a stationary body, as depicted in the drawings. In this example the direction of airflow as indicated by arrow S is perpendicular to the surface of the cylindrical body at point P, which is called the "stagnation point". This is equivalent to forward relative movement of the body 2 through the air in the direction of arrow M.

On either side of the stagnation point P the airflow splits into two streams F1, F2 that pass around opposite sides of the cylindrical body 2. Up to approximately the widest point of the cylindrical body relative to the flow direction, the airflow is substantially laminar, allowing a boundary layer to build up against the surface of the cylindrical body 2.

After passing the widest point of the cylindrical body 2 relative to the direction of flow, the flow streams F1, F2 tend to separate from the surface of the cylindrical body forming vortices V in the region behind the cylindrical body. This creates a low pressure zone L behind the cylindrical body 2 and the resulting pressure difference between the front and the rear faces 5, 6 of the cylindrical body creates a pressure drag force $F_d$ that opposes movement of the cylindrical body relative to the air. The movement of air over the surface of the cylindrical body also creates a surface friction force $F_s$, which is usually much smaller than the drag force $F_d$ at relative speeds in the range 6-40 m/sec.

The points where the boundary layer separates from the surface of the cylindrical body 2 are called the transition points $T_1$, $T_2$. The pressure drag force $F_d$ experienced by the cylindrical body 2 depends in part on the area of the cylindrical body located within the low pressure zone L between the transition points $T_1$, $T_2$. If the transition points $T_1$, $T_2$ can be moved rearwards, this will reduce the size of the area affected by the low pressure zone L, thereby reducing the pressure drag $F_d$ acting on the cylindrical body 2.

It is known that the transition points $T_1$, $T_2$ can be shifted rearwards by providing a suitable texture 8 on the surface of the cylindrical body 2. It should be understood that the texture pattern 8 shown on the upper part of the cylindrical body 2 may also be repeated on the lower side of the body. In the present invention we have sought to design a fabric with an optimum surface texture to maximise the reduction in pressure drag $F_d$ without significantly increasing surface friction drag $F_8$.

As illustrated in FIG. 1 we have discovered that the pressure drag force $F_d$ can be reduced substantially, without significantly increasing the surface friction drag force $F^s$ by covering the cylindrical body 2 with a fabric 3 having a textured pattern 8 on its outer surface, wherein the height of the texture pattern 8 in the direction perpendicular to the surface of the cylindrical body 2 increases gradually from the front face 5 to the rear face 6 of the cylindrical body 2. For example, we have found that the fabric 3 covering the cylindrical body 2 may have a surface texture as illustrated in FIG. 2, which depicts the optimum values of the texture height H versus surface angle θ for cylinders with radii of 100 mm and 200 mm, where the surface angle θ is the angle subtended between the direction of forward movement M and a line 7 that is perpendicular to the surface of the cylindrical body.

As illustrated in FIG. 2, for a cylindrical body with a radius r of 100 mm the height H of the texture optimally increases from 0 mm at θ=0° to about 100 μm at θ=30°, then increases more rapidly to about 500 μm at θ=60°, and then increases more gradually to reach a height of about 800 μm at θ=180°. For a cylindrical body with a radius r of 200 mm the height of the texture optimally increases from 0 mm at θ=0° to about 100 μm at θ=30°, and then increases at a uniform rate reaching a height of about 800 μm at θ=180°.

More generally, we have found that in certain embodiments the textured fabric 3 covering the surface of a cylindrical body 2 can be divided into a number of zones including a first zone A, a second zone B and a third zone C that are defined in relation to the forward direction of movement M, as shown in FIG. 1. In this embodiment the first zone A is located generally in an inner front region of the cylindrical body 2, the second zone B is located generally in an outer front region of the cylindrical body 2, and the third zone C is located generally in a rear region of the cylindrical body 2. In the first zone A the texture has a mean height $H_A$ in the range 0-200 μm, in the second zone the texture has a mean height $H_B$ that is greater than $H_A$ and preferably in the range of 100-500 μm, and in the third zone the texture has a mean height $H_C$ that is greater than $H_B$ and preferably greater than 200 μm.

Alternatively (or additionally), the texture pattern can be defined in terms of the maximum and minimum texture height in each of the three zones. Thus, in one exemplary embodiment, in the first zone A the textured region has a texture height that increases from a minimum height $H_{A1}$ in the range 0-50 μm to a maximum height $H_{A2}$ in the range 100-400 μm, in the second zone B the textured region has a texture height that increases from a minimum height $H_{B1}$ in the range 100-400 μm to a maximum height $H_{B2}$ in the range 200-1000 μm, and in the third zone C the textured region has a texture height that increases from a minimum height $H_{C1}$ in the range 200-1000 μm to a maximum height $H_{C2}$ that is greater than 300 μm.

The first zone A may be defined as comprising the region of the textured fabric in which the surface angle θ is less than a maximum value $\theta_A$ in the range 10° to 25°.

The second zone B may be defined as comprising the region of the textured fabric in which the surface angle θ is greater than $\theta_A$ and less than a maximum value $\theta_B$ in the range 60°-105°, preferably 60°-95°.

The third zone C may be defined as comprising the region of the textured fabric in which the surface angle θ is greater than $\theta_B$. Therefore, in an embodiment, the third zone C may comprise at least one region of the garment in which the surface angle θ is greater than a minimum value $\theta_{C1}$ in the range 60°-105°, preferably 60°-95°. The third zone C extends rearwards from the outer (or rear) edge of the second zone B to the rearmost point of the cylindrical body: i.e. the point diametrically opposed to the stagnation point P on the front face of the cylindrical body.

In one embodiment the texture pattern 8 has a height H that varies substantially continuously (or quasi-continuously) and increases with the surface angle θ throughout one or more of the first, second and third zones. For example, as illustrated in FIG. 2, in the case of a cylindrical body with a radius r of 100 mm, the height of the pattern increases steadily in the first zone A from a height of 0 mm where θ=0° to approximately 100 μm at a surface angle θ of approximately 30°, then increases more rapidly in the second zone B to a height of about 500 μm at a surface angle θ of about 60°, and then increases more gradually in the third zone C to a height of approximately 800 μm at a surface angle θ of 180°.

As discussed above, the term "substantially continuously" is intended to cover both a continuous increase in the texture height and a quasi-continuous increase in texture height, consisting of a plurality of incremental or step-wise increases in the texture height, as may be required according to the manufacturing process used. In the latter case the incremental increases in texture height will be very small, for example less than 0.2 mm and preferably no more than 0.1 mm, so that the increase in texture height is effectively continuous.

In the case of a cylindrical body with a radius of 200 mm, the height of the pattern increases steadily in the first zone A from a height of 0 mm where θ=0° to approximately 100 μm at a surface angle of approximately 30°, then increases more rapidly through the second zone B and the third zone C to reach a height of approximately 800 μm at a surface angle of 180°. These curves are valid with slight variations for cylindrical bodies with a radius in the range 60-300 mm and for speeds in the range 6-40 m/sec.

The texture pattern 8 can take various different forms, some examples of those forms being illustrated in FIGS. 3-6. The pattern illustrated in FIGS. 3 and 4*a* comprises a staggered array of cylindrical texture formations 8 with a mean separation D between the formations typically in the range 1 mm to 40 mm. The height of the texture pattern corresponds to the height H of the formations 8. The texture formations 8 may have different heights H in different zones of the garment.

FIG. 4*b* illustrates a variant of the pattern shown in FIG. 4*a*, in which the height H of the texture pattern varies substantially continuously (quasi-continuously). The pattern again comprises a staggered array of cylindrical texture formations 8*a*, 8*b*, 8*c* with a mean separation D between the formations typically in the range 1 mm to 40 mm. The height of the formations 8*a*, 8*b*, 8*c* increases incrementally, the first formation 8*a* having a height Ha, the second formation 8*b* having a height Hb and the third formation 8*c* having a height He where Hc>Hb>Ha. The incremental increase in the height of the formations (for example Hc-Hb or Hb-Ha) is preferably less than 200 μm, more preferably less than 150 μm, and even more preferably less than 100 μm, so that the increase in height is effectively continuous.

Figure 6B:
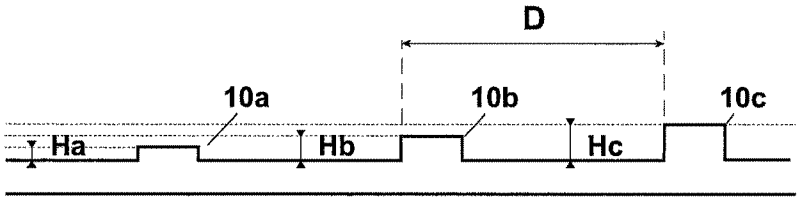
FIG. 6*b* is a modified version of the second texture pattern.
Figure 6A:
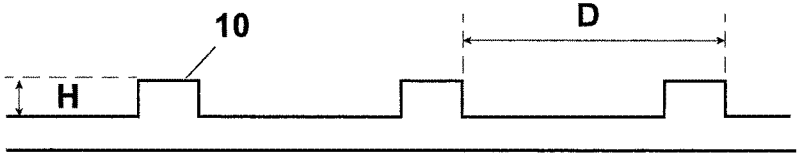
FIG. 6*a* is a sectional view of the second texture pattern.
Figure 5:
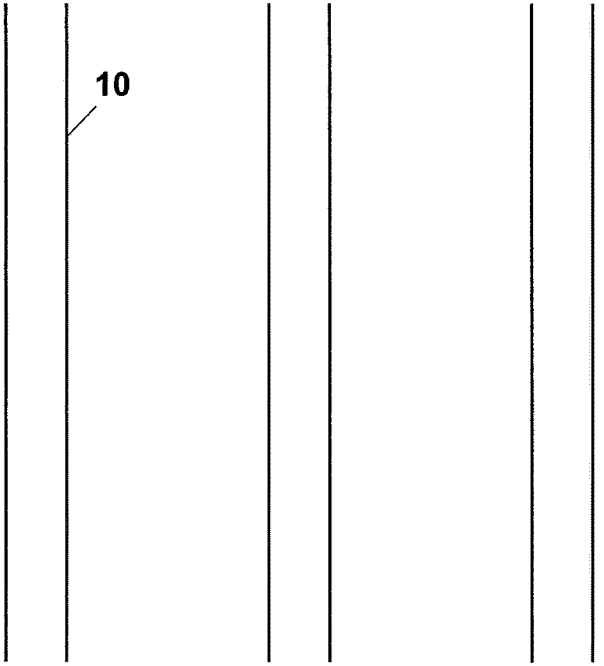
FIG. 5 is a plan view of a second texture pattern according to an embodiment of the invention.

Another textured pattern illustrated in FIGS. 5 and 6*a* comprises a set of parallel ridges 10 with a separation D in the range 1 mm to 40 mm, preferably 2 mm to 20 mm. The height of texture pattern again corresponds to the height H of the formations. In this embodiment the ridges 10 are preferably arranged to be substantially perpendicular to the expected direction of airflow over the surface. (By comparison, the texture pattern illustrated in FIGS. 3 and 4 is essentially omnidirectional and thus does not depend on the direction of airflow over the surface). The texture formations 10 may have different heights H in different zones of the garment.

FIG. 6*b* illustrates a variant of the pattern shown in FIG. 6*a*, in which the height H of the texture pattern varies substantially continuously (quasi-continuously). The pattern again comprises a set of parallel ridges 10*a*, 10*b*, 10*c* with a mean separation D between the formations typically in the range 1 mm to 40 mm. The height of the formations 10*a*, 10*b*, 10*c* increases incrementally, the first formation 10*a* having a height Ha, the second formation 10*b* having a height Hb and the third formation 10*c* having a height Hc where Hc>Hb>Ha. The incremental increase in the height of the formations (for example Hc-Hb or Hb-Ha) is preferably less than 200 μm, more preferably less than 150 μm, and even more preferably less than 100 μm, so that the increase in height is effectively continuous.

It should be noted that the texture patterns illustrated in FIGS. 3-6 are only examples of the many different patterns that may be used.

In the case of a garment made from a textured fabric, the fabric may in an embodiment have a texture that varies within a seamless portion of the fabric so that the pattern is not disrupted by seams, as seams may affect the airflow over the surface. This can be achieved for example by using a jacquard knitted fabric. Alternatively, the texture pattern can be printed onto the fabric or it can be created by applying a suitable solid material, for example silicone, to the surface of the fabric. The silicone may for example be applied to the surface of the fabric using a 3D printer.

The garment is preferably an article of sports clothing, which may be used for any sport where the reduction of drag is important. This applies particularly to sports where the input power is limited (for example being supplied by the athlete or the force of gravity) and where the athlete travels at a speed typically in the range 6-20 m/sec, for example cycling, running and speed skating, or possibly up to 40 m/s or more for some sports, for example downhill skiing. The article of clothing may for example consist of a shirt, trousers, leggings, shorts, bibshorts, shoes, overshoes, arm covers, calf guards, gloves, socks or a one-piece bodysuit. The article of clothing may also be an item of headwear, for example a hat or helmet, or a fabric covering for a helmet.

Figure 9:
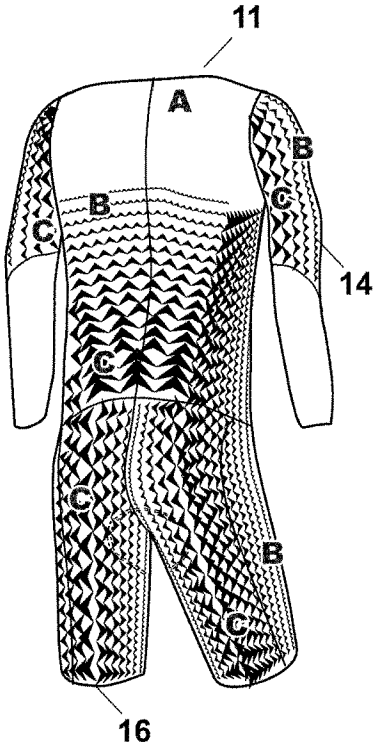
FIG. 9 is a rear perspective view of the bodysuit shown in FIG. 7.
Figure 8:
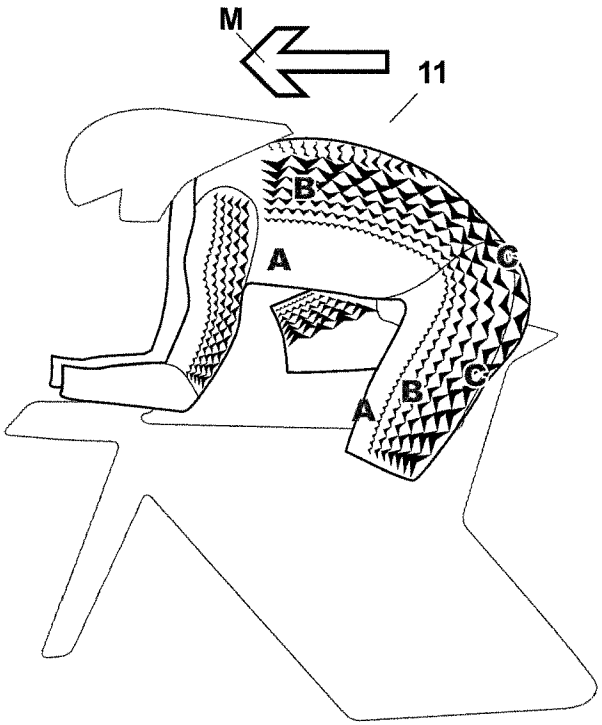
FIG. 8 is a schematic side view of a cyclist wearing the bodysuit shown in FIG. 7.
Figure 7:
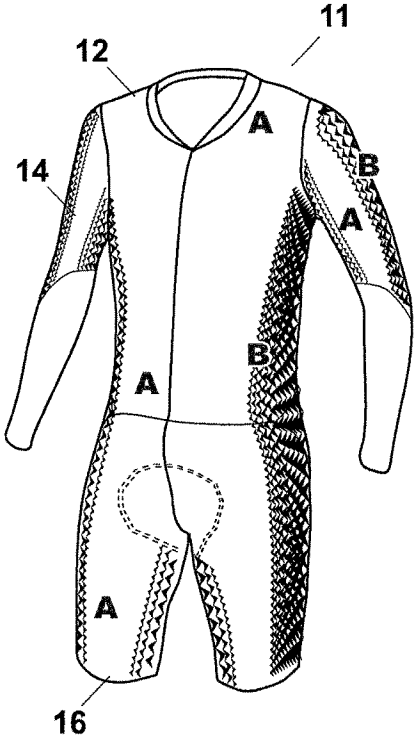
FIG. 7 is a front perspective view of a bodysuit for cycling.

An example of a garment intended for use while cycling is illustrated in FIGS. 7, 8 and 9. The garment in this case is a one-piece bodysuit 11 comprising a body portion 12 that covers the athlete's trunk, with short sleeves 14 and legs 16 that cover the upper portions of the athlete's arms and legs. The garment has a plurality of zones that are defined in relation to the direction of forward travel M of the athlete, and which take account of the athlete's posture. The zones include a first zone A located generally in an inner front region of the garment, a second zone B located in an outer front region of the garment and a third zone C that is located in a rear region of the garment. The outer surface of the garment has a texture that varies across the three zones, the texture having typically a height of 0-150 μm in the first zone A, a height of 150-500 μm in the second zone B and a height greater than 500 μm in the third zone C.

In this example, the first zone A is located primarily on the chest and shoulder regions of the trunk 12 and on the forward facing portions of the sleeves 14 and the legs 16. The second zone B with an increased texture height is located primarily on the side and back regions of the body 12 and side regions of the sleeves 14 and the legs 16. The third zone C having the greatest texture height is located primarily on the lower back portion of the body 12 and the rear portions of the sleeves 14 and the legs 16. This arrangement of texture patterns has been found to be particularly advantageous for cyclists adopting the classic crouched posture illustrated in FIG. 8. It will be appreciated that in other sports where the athletes adopt different postures, the arrangement of the texture patterns will be adapted as required to provide a low level of pressure drag.

The invention claimed is:

1. A low drag garment comprising a plurality of zones including a first zone A, a second zone B and a third zone C, wherein the first zone A is located generally in a laterally inner front region of the garment, the second zone B is located in a laterally outer front region of the garment and the third zone C is located in a rear region of the garment, wherein the garment is an article of sports clothing, wherein the garment is made from a fabric comprising a textured region with a texture height H that increases from the front to the rear of the garment, wherein in first zone A the textured region has a mean texture height $H_A$ in the range 0-200 μm, in the second zone B the textured region has a mean texture height $H_B$ that is both greater than $H_A$ and also in the range of 100-500 μm, and in the third zone C the textured region has a mean texture height $H_C$ that is greater than $H_B$.

2. A low drag garment according to claim 1, wherein in the third zone C the textured region has a mean texture height $H_C$ that is greater than 200 μm.

3. A low drag garment according to claim 1, wherein the textured region has a texture height H that increases substantially continuously in one or more of the first, second and third zones.

4. A low drag garment according to claim 3, wherein within the textured region the substantially continuous increase in texture height H comprises a plurality of incremental increases in texture height, and wherein each incremental increase in texture height is less than 200 μm.

5. A low drag garment according to claim 1, wherein the textured region comprises a plurality of texture formations having a mean spacing D in the range 1 mm to 40 mm.

6. A low drag garment according to claim 1, wherein the fabric has a texture height that varies within a seamless portion of the fabric.

7. A low drag garment according to claim 1, wherein the textured region of the fabric has a texture that provides said texture height, said texture provided by jacquard knitting of the fabric, or by printing a 3D pattern on the outer surface of the fabric, or by the application of a solid material to an outer surface of the fabric.

8. A low drag garment according to claim 1, wherein the garment is an article of sports clothing for use in cycling, running, skiing, horse racing or speed skating.

9. A low drag garment according to claim 1, wherein the garment is a shirt, trousers, leggings, shorts, bibshorts, shoes, overshoes, arm covers, calf guards, gloves, socks or a bodysuit.

10. A low drag garment according to claim 3, wherein within the textured region the substantially continuous increase in texture height H comprises a plurality of incremental increases in texture height, and wherein each incremental increase in texture height is less than 150 μm.

11. A low drag garment according to claim 3, wherein within the textured region the substantially continuous increase in texture height H comprises a plurality of incremental increases in texture height, and wherein each incremental increase in texture height is less than 100 μm.

12. A low drag garment according to claim 1, wherein the textured region comprises a plurality of texture formations having a mean spacing D in the range 2 mm to 20 mm.

* * * * *